United States Patent [19]

Nelson

[11] 4,164,317

[45] Aug. 14, 1979

[54] CENTRIFUGE WITH AUTOMATIC SLUDGE DISCHARGE

[75] Inventor: Kurt Nelson, Pleasant Valley, N.Y.

[73] Assignee: The De Laval Separator Company, Poughkeepsie, N.Y.

[21] Appl. No.: 899,212

[22] Filed: Apr. 24, 1978

[51] Int. Cl.[2] ..... B04B 1/18

[52] U.S. Cl. ..... 233/20 A

[58] Field of Search ..... 233/20 R, 20 A, 19 R, 233/19 A

[56] References Cited

U.S. PATENT DOCUMENTS

| | | | |
|---|---|---|---|
| 3,189,267 | 6/1965 | Thylefors | 233/20 A |
| 3,494,546 | 2/1970 | Nilson | 233/20 R |
| 4,015,773 | 4/1977 | Thylefors | 233/20 A |

*Primary Examiner*—George H. Krizmanich

*Attorney, Agent, or Firm*—Cyrus S. Hapgood

[57] ABSTRACT

The sludge outlets of the centrifugal rotor are normally closed by a piston valve which moves axially to open these outlets when operating liquid is drained through openings at the periphery of a closing chamber adjacent the valve, the drain openings being normally closed by a main slide with which the rotor forms an opening chamber. Operating liquid fed to the opening chamber first moves the main slide axially to open the drain openings, thereby effecting opening of the sludge outlets, and then overflows into a third chamber to actuate a second slide and thereby open a drain passage leading from the periphery of the opening chamber into the third chamber, whereby the main slide is returned to its normal position for re-closing the drain openings from the closing chamber.

6 Claims, 4 Drawing Figures

CENTRIFUGE WITH AUTOMATIC SLUDGE DISCHARGE

This invention relates to sludge centrifuges of the type in which the discharge of separated sludge through peripheral outlets of the centrifugal rotor is controlled by a piston valve movable axially of the rotor to effect intermittent opening and closing of the sludge outlets. More particularly in a centrifuge of the type to which the invention relates, operating liquid fed into a closing chamber of the rotor exerts sufficient pressure on the piston valve to hold it in position for closing the sludge outlets against the pressure of the mixture in the rotor's separating space, and the sludge outlets are opened by discharging operating liquid through drain openings at the periphery of the closing chamber, thus causing movement of the piston valve from its closing position.

It is common practice to effect opening and closing of these drain openings by a slide movable axially of the rotor under control of an operating liquid supplied intermittently to an opening chamber adjacent the slide, as disclosed in U.S. Pat. No. 3,550,843 granted Dec. 29, 1970, in the name of Walter Hoffman. However, prior centrifuges provided with such a slide have been subject to one or more operating difficulties. For example, the slide tends to respond sluggishly to the supply of operating liquid to the opening chamber when the sludge outlets are to be opened; and the duration of each open period of the sludge outlets is difficult to control accurately. Also, operation of the slide is influenced adversely by changes in the pressure at which the operating liquid is supplied.

An object of the present invention is to provide a sludge centrifuge of the type described which avoids the above-noted difficulties.

In a centrifuge made according to the invention, the above-mentioned opening chamber has a normally closed drain passage at its radially outer portion and has an overflow passage at its radially intermediate portion, these passages leading to a third chamber formed between the aforementioned slide (constituting a main slide) and a second slide movable relative to both the rotor and the main slide. As operating liquid is supplied to the inner portion of the opening chamber and accumulates in its outer portion, it first actuates the main slide to open the drain openings of the closing chamber, so that the sludge outlets are opened; and continued supply of operating liquid causes a flow thereof through the overflow passage to the third chamber where the liquid actuates the second slide to open the drain passage from the opening chamber. The resulting flow of liquid at high pressure into the third chamber act quickly on the main slide to return it to its closing position, whereby operating liquid entering the closing chamber will accumulate therein so as to cause the piston valve to re-close the sludge outlets.

These and other features of the invention will be better understood from the following description in conjunction with the accompanying drawings, in which.

Figure 1:
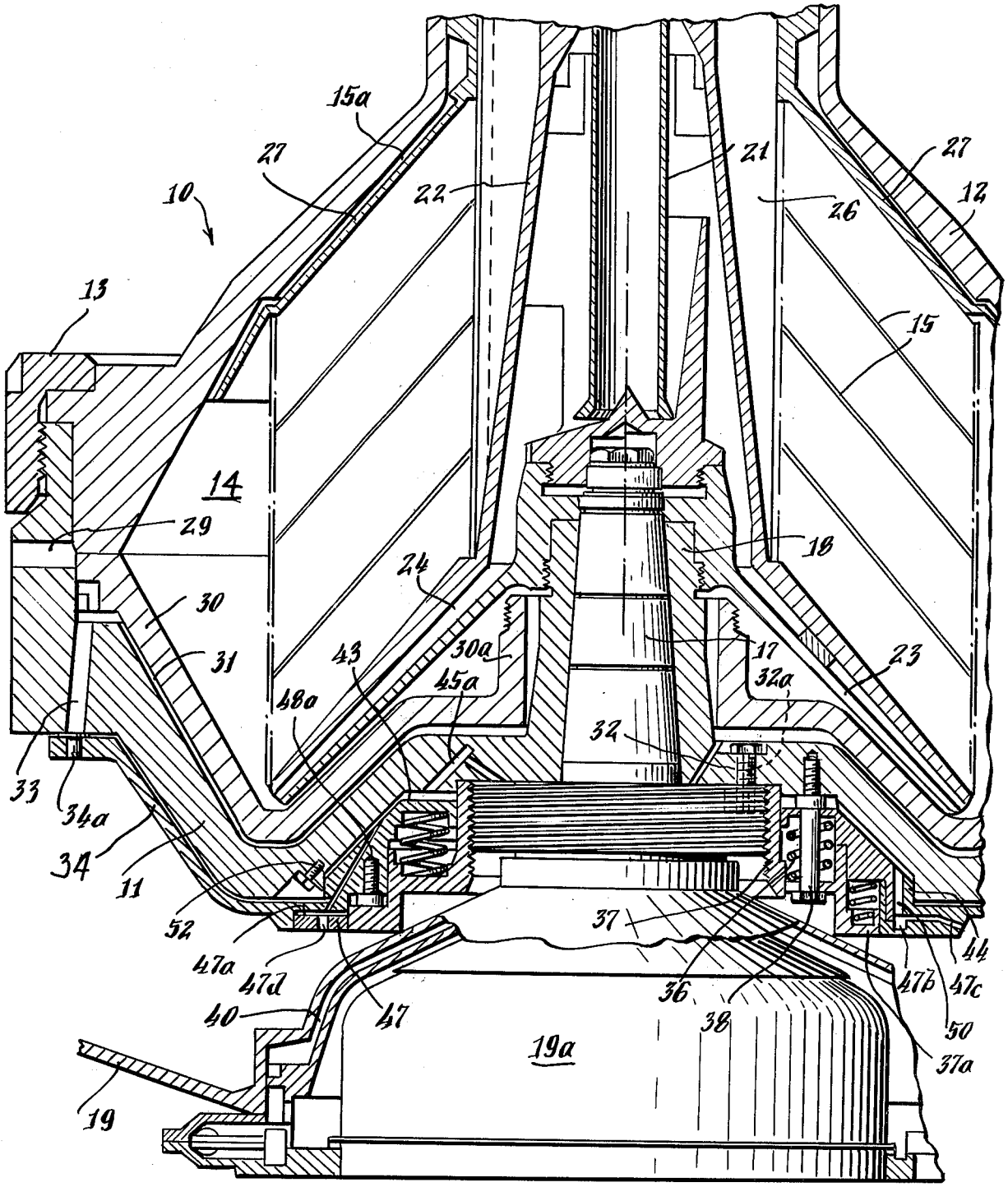
FIG. 1 is a vertical sectional view of a preferred form of the new centrifuge.

Referring to FIG. 1, the centrifuge there shown comprises a rotor 10 in the form of a bowl having a main portion 11 and a cover 12 which are releasably interconnected by a locking ring 13. The rotor forms a separating chamber or space 14 containing a set of conical discs 15.

The rotor 10 is mounted on a vertical driving spindle 17 extending into a hollow nave 18 of the rotor portion 11. Spindle 17 is mounted for rotation in a stationary frame 19 which includes a bearing housing **19*a*** for the spindle, the latter being driven from a motor (not shown).

The sludge-containing liquid is fed into rotor 10 through a stationary feed tube 21 located on the rotor axis and extending downward through a central opening in cover 12. More particularly, the rotor includes a tubular shaft or distributor 22 which receives feed tube 21 and delivers the feed to separating space 14 by way of a conical passage 24 formed between distributor 22 and a conical member 23 secured to the nave 18.

The light phase separated in space 14 is displaced inwardly from the conical discs 15 to a central passage 26 surrounding distributor 22, this phase then flowing upwardly for discharge through the top of the rotor in any conventional manner. The rotor may also include a passage 27 formed between a top disc **15*a* and the rotor cover 12**, this passage serving for discharge of an intermediate phase from the separating space.

The sludge separated in space 14 is discharged intermittently through peripheral outlets 29 in the rotor portion 11. The sludge outlets 29 are normally closed by an axially movable piston valve 30 having a central hub **30*a* surrounding the nave 18 and supported laterally thereby. Piston valve 30 is held in its upper or closing position by an operating liquid fed into a closing chamber 31 formed between piston valve 30 and the bottom of rotor portion 11, the latter having at its inner part a bolt 32 with a passage 32*a* for admitting the operating liquid. At its outer part, rotor portion 11 has generally vertical passages leading downward from the outer part of closing chamber 31 and distributed around the rotor axis, one such passage being shown at 33. Passages 33 are normally closed at their lower ends by valve elements 34*a* secured to a main slide valve 34 located below the bottom of main rotor portion 11, but downward movement of slide valve 34 opens these passages so as to drain operating liquid from closing chamber 31**.

Slide valve 34 is urged upwardly toward its passage-closing position by compression springs distributed around the rotor axis and one of which is shown at 36. Each spring 36 bears at its upper end against slide valve 34 and at its lower end against a collar 37 surrounding the rotor axis and secured to rotor portion 11 by bolts 38. Collar 37 is closely surrounded by slide valve 34.

Centrifuge frame 19 has a passage 40 through which operating liquid is delivered to the inner portion of closing chamber 31 via a generally annular chamber 41 of the rotor and the passage 32. Chamber 41 is located within collar 37 and receives the operating liquid directly from the outlet end of stationary passage 40.

An annular space 43 is formed between the bottom of rotor part 11 and main slide valve 34, this space being sealed at its outer portion by a seal 44. From chamber 41, operating liquid can flow over an inner edge **41*a* into a passage 45 within collar 37 and thence through channel 45*a* in rotor part 11 to the inner portion of space 43**, which may be referred to as an opening chamber.

A second slide valve 47 closely surrounds an outward extension of collar 37 and, in turn, is closely surrounded by a lower extension of main slide valve 34, valve 47 being movable axially relative to the parts 34 and 37. Replaceable overflow nozzles 48 (FIGS. 2–3) are located at the inlet ends of overflow passages 48*a* leading from an intermediate part of opening chamber 43 to an annular space 47*a* forming a third chamber above the outer part of secondary valve 47. The overflow nozzles 48 (of which only one is shown) are distributed around the rotor axis. Secondary valve 47 is urged upwardly by compression springs spaced around the rotor axis and one of which is shown at 49, these springs being seated on an outer flange 37*a* of collar 37. Main slide valve 34 is formed with drain passages 50 leading from the outer part of opening chamber 43 and normally closed by valve elements 47*b* secured to secondary slide valve 47. In the normal operation of the centrifuge, main slide valve 34 is held in its upper or closing position by springs 36. Thus, chamber 31 remains filled with operating liquid which it has received from passage 32, thereby holding piston valve 30 in its upper position for closing sludge outlets 29. Also, there is no overflow of operating liquid from chamber 41 to passages 45–45*a*, and opening chamber 43 is devoid of operating liquid.

Figure 2:
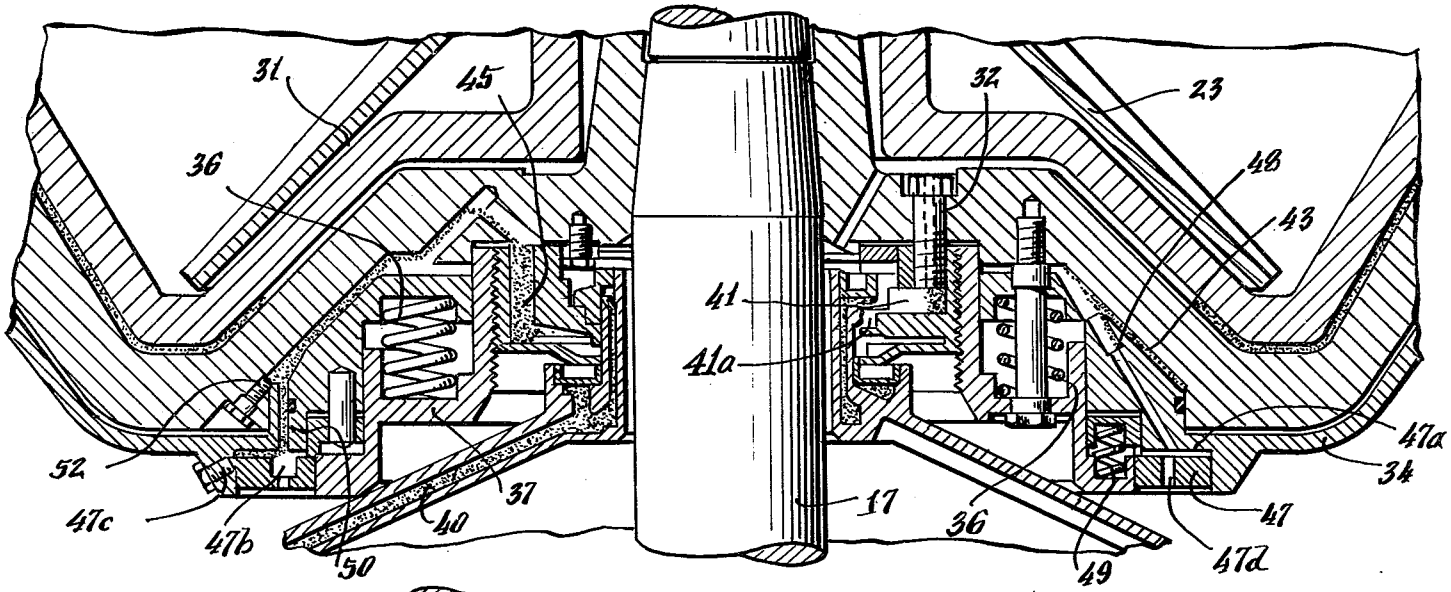
FIGS. 2, 3 and 4 are similar views of parts of the centrifuge and indicating the locations of the operating liquid at different stages in the operation of the slides.

When separated sludge is to be discharged from rotor 10, the rate of water feed through passage 40 is increased, as by the action of a solenoid valve (not shown), so that water overflows the edge 41*a* of rotor chamber 41 and enters the opening chamber 43 via channels 45–45*a* forming what may be termed a third passage. Some of the entering water drains from the periphery of chamber 43 through a permanently open nozzle 52, but this drain rate is small compared to the entering rate of the water. As the water level in chamber 43 moves inward toward the rotor axis, the hydraulic pressure overcomes the force of springs 36 and depresses main slide valve 34 so as to open passages 33 and thus drain water from closing chamber 31. This results in downward movement of piston valve 30, thereby opening sludge outlets 29. Main slide 34 descends until the water level in opening chamber 43 reaches the overflow nozzles 48, whereupon the incoming water overflows into space 47*a*. The resulting hydraulic pressure on secondary slide valve 47 overcomes the action of springs 49 and depresses valve 47 sufficiently to open drain passages 50 (FIG. 2).

Figure 3:
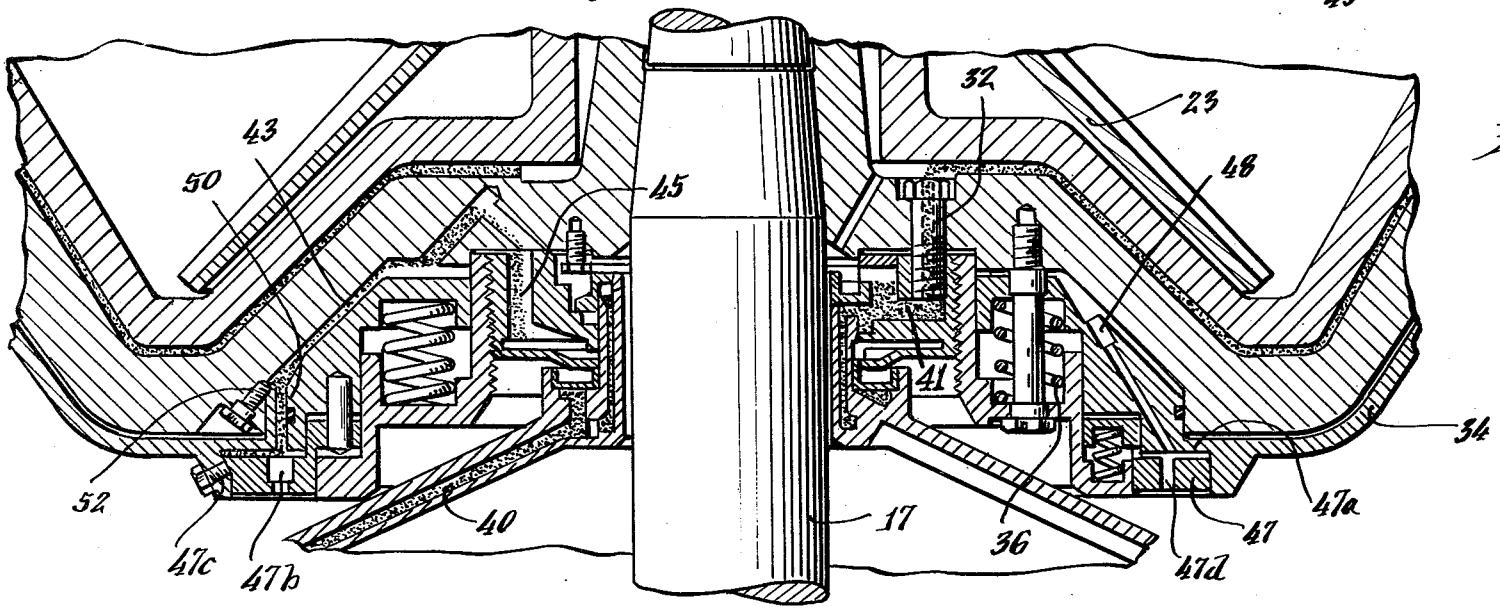

The water above main slide 34 drains rapidly through drain passages 50 into space 47*a* so that secondary slide 47 is depressed fully and quickly against its stop formed by collar flange 37*a*. The resulting hydraulic pressure in space 47*a*, in addition to the action of springs 36, returns main slide 34 quickly to its upper or closing position. Consequently, the water from chamber 41 entering closing chamber 31 now re-fills the latter to cause piston valve 30 to close sludge outlets 29. Any excess of water entering space 47*a* discharges through overflow holes 47*d* in secondary slide 47 (FIG. 3).

The outer part of the annular space 47*a* above secondary slide 47 is located at a substantially greater radius from the rotor axis than the opening chamber 43 and therefore is subjected to a substantially greater centrifugal force. Accordingly, when this outer part of space 47*a* is completely filled with water, the upward hydraulic and spring forces on main slide 34 are sufficient to raise it to its closing position despite a substantial quantity of water in opening chamber 43. Moreover, main slide 34 can be raised to its closing position even if operating water continues to enter chamber 43 via overflow edge 41*a*, because the main drain passages 50 will drain the water faster than it can enter chamber 43.

Figure 4:
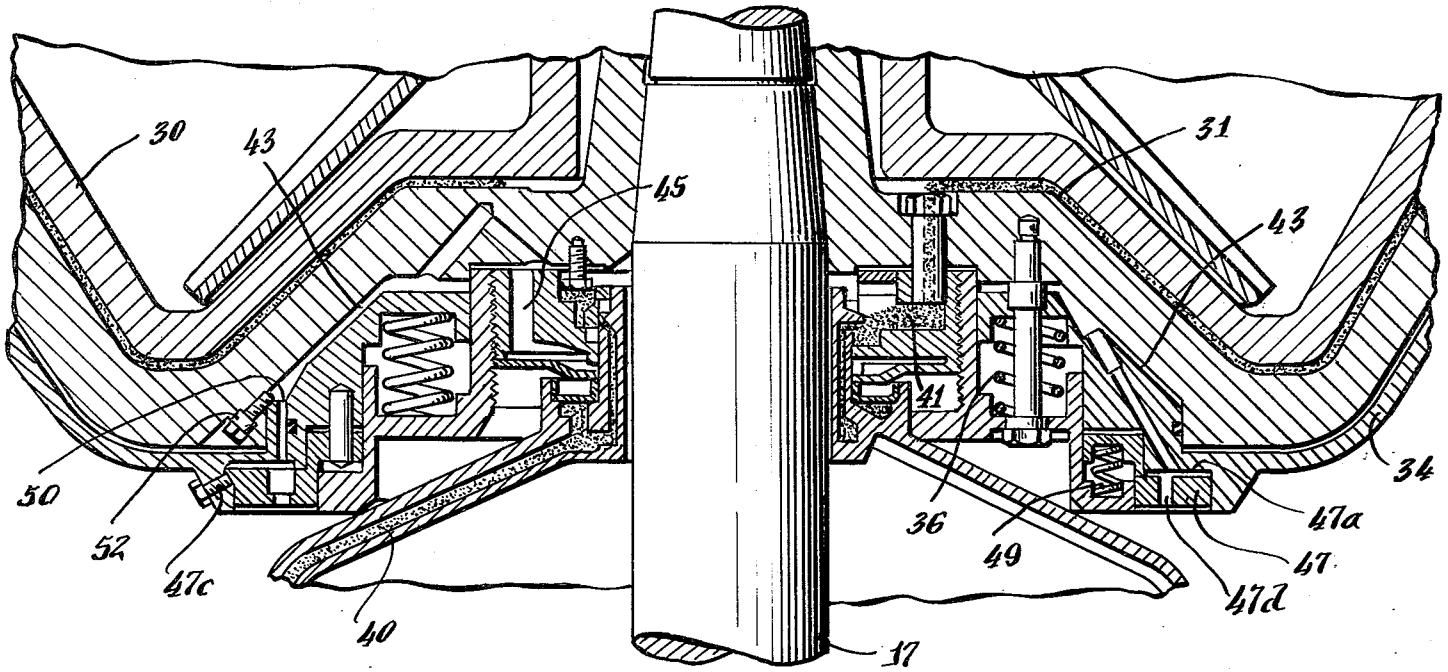

As shown in FIG. 4, a small nozzle 47*c* drains water from the outer periphery of space 47*a*, but as long as water continues to drain from chamber 43 through passages 50, the outer part of space 47*a* remains filled with water so as to hold secondary slide 47 in its lower (open) position. However, when there is no water feed through passage 40 so that water no longer enters opening chamber 43 via overflow edge 41*a*, nozzle 47*c* will drain the water completely from space 47*a*, so that springs 49 return secondary slide 47 to its upper position where it re-closes the passages 50. The small drain nozzle 52 drains water from the outermost part of opening chamber 43.

Of course, the flow rate through nozzle 47*c l is less than the rate at which operating liquid is supplied to chamber 47a* through either the nozzles 48 or the passages 50.

It will be understood that each sludge discharge, known as a "shot", is initiated by causing operating water to enter and accumulate in opening chamber 43 via overflow edge 41*a*, and the shot is terminated automatically when the overflow through nozzles 48 depresses the secondary slide 47. Thereafter, reduction of the water supply rate through passage 40, to discontinue the overflow into opening chamber 43, can be effected at any time which will allow complete draining of space 47*a* prior to the next shot. The changes in the water supply rate through passage 40 may be controlled automatically by a timer or other conventional means (not shown).

The size of each shot, that is, the amount of sludge discharged each time the sludge outlets 29 are opened, is determined by the location of the inlet ends of overflow nozzles 48. Thus, the shot size can be adjusted by installing longer nozzles for a larger shot or shorter nozzles for a smaller shot. Also, the new centrifuge can tolerate large fluctuations in the pressure at which the operating water is supplied through passage 40, without missing a shot.

I claim:

1. A sludge centrifuge comprising a hollow rotor mounted for rotation about an axis and having a separating space provided with an inlet for a sludge-containing liquid and with an outlet for separated liquid, the rotor also having a peripheral outlet for discharge of sludge separated in said space, a piston valve located in the rotor and movable axially thereof to open and close the sludge outlet, said valve forming with the rotor a closing chamber having at its radially outer portion a normally closed drain opening for an operating liquid, means for supplying operating liquid to said closing chamber to substantially fill the same when said drain opening is closed, whereby the operating liquid holds the piston valve in position to close the sludge outlet, a main slide valve biased to a normal position for closing said drain opening but movable axially of the rotor to a second position for opening said drain opening, thereby causing axial movement of the piston valve to open the sludge outlet, said slide valve forming with the rotor an opening chamber having at its radially outer portion a drain passage and at its radially intermediate portion an overflow passage, and a second slide valve mounted on the rotor and movable relative thereto and relative to said main slide, valve said second and main slide valves forming a third chamber to which said passages lead, said second slide valve having a normal position in which it closes said drain passage while said overflow passage communicates with the third chamber, the rotor forming a third passage for supplying operating liquid to said opening chamber to force the main slide valve to its said second position, said overflow passage being positioned to supply overflow liquid from said opening chamber to said third chamber to displace the second slide valve from its said normal position and thereby open said drain passage, whereby operating liquid is drained from said opening chamber and the main slide valve is returned to its said normal position.

2. The centrifuge of claim 1, in which the inlet end of said overflow passage is adjustable.

3. The centrifuge of claim 1, comprising also a nozzle for draining operating liquid from the radially outer portion of said third chamber at a rate less than the rate at which liquid is supplied through each of said drain and overflow passages, the liquid entering the third chamber from said drain passage being operable on the main slide valve to urge it toward its said normal position.

4. The centrifuge of claim 1, comprising also a nozzle for draining operating liquid from the radially outer portion of said opening chamber at a rate less than the rate at which liquid is supplied by said third passage.

5. The centrifuge of claim 1, in which said third chamber has an overflow outlet.

6. The centrifuge of claim 1, comprising also spring means holding each of said slide valves in its said normal position.

* * * * *